United States Patent [19]

Hebda

[11] 3,946,523

[45] Mar. 30, 1976

[54] DEVICE FOR ASSISTING THE OPENING OF A DOOR

[76] Inventor: Thomas Hebda, 235 Vance, Lombard, Ill. 60148

[22] Filed: Aug. 8, 1974

[21] Appl. No.: 495,663

[52] U.S. Cl. ..... 49/38; 49/72; 49/171; 98/87

[51] Int. Cl.[2] ..... E06B 7/02

[58] Field of Search ..... 49/38, 72, 171, 70; 98/87, 98/96, 41 SV

[56] References Cited

UNITED STATES PATENTS

| | | | |
|---|---|---|---|
| 1,218,684 | 3/1917 | Mitchell | 49/38 |
| 1,939,312 | 12/1933 | Murray | 49/38 |
| 1,965,725 | 7/1934 | Smith et al. | 49/171 |
| 3,073,525 | 1/1963 | Cislo | 98/41 SV |
| 3,337,990 | 8/1967 | Iwata | 49/3 |

*Primary Examiner*—Kenneth Downey
*Attorney, Agent, or Firm*—Carl C. Batz

[57] ABSTRACT

Apparatus for assisting the opening of a door when the door is subjected to added air pressure tending to hold the door closed, the door being provided with openings therethrough and including means for closing the openings but which will operate to remove the closure upon operation of means for unlatching the door.

6 Claims, 11 Drawing Figures

DEVICE FOR ASSISTING THE OPENING OF A DOOR

This invention relates to a device for assisting the opening of a door, and more particularly to such a device including a door with air passages therethrough and means for opening and closing such passages to vary the air pressure applied to the door.

BACKGROUND

It is common to provide spring or air cushion devices which operate to open or close doors, but there are situations where a door is subjected to pressures which make opening the door by hand very difficult or impossible. One such situation is the fire escape stairwell which is commonly constructed in multi-story buildings. Such stairwells extend between floors of the buildings and have doors to each of the floors. A main function of such stairwells is to provide an escape for occupants on a floor in the event of a fire, and at the same time prevent the spreading of a fire between floors.

More recently it has been the practice to provide an air blower which in the event of a fire alarm will create a pressure in the chamber defined by the stairwell so that when the door to the stairwell is opened on any floor on which there is a fire the draft will be from the interior toward the exterior of the chamber rather than from the floor into the stairwell. The effect of this is to keep the fire from entering the stairwell and passing to other floors.

One difficulty with such an arrangement is that the pressure generated by the blower is applied to the inside of the door and it becomes difficult or impossible to move the door by hand about its hinges into the stairwell to open the door. Further, it is necessary that the door be opened and closed normally in the absence of any fire alarm.

In my copending patent application Ser. No. 451,042 filed Mar. 14, 1974 I describe a device for assisting the opening of a door in a situation such as that above referred to. In that application I described means responsive to the fire alarm or other such signal floor releasing the mechanism for assisting the opening of the door.

It is one of the objects of the present invention to provide mechanism which will be operable when persons attempt to open the door and will provide assistance in overcoming the air pressure which tends to hold the door in a closed position.

DRAWINGS

One embodiment of my invention is illustrated in the accompanying drawings in which—

DETAILED DESCRIPTION

Figure 1:
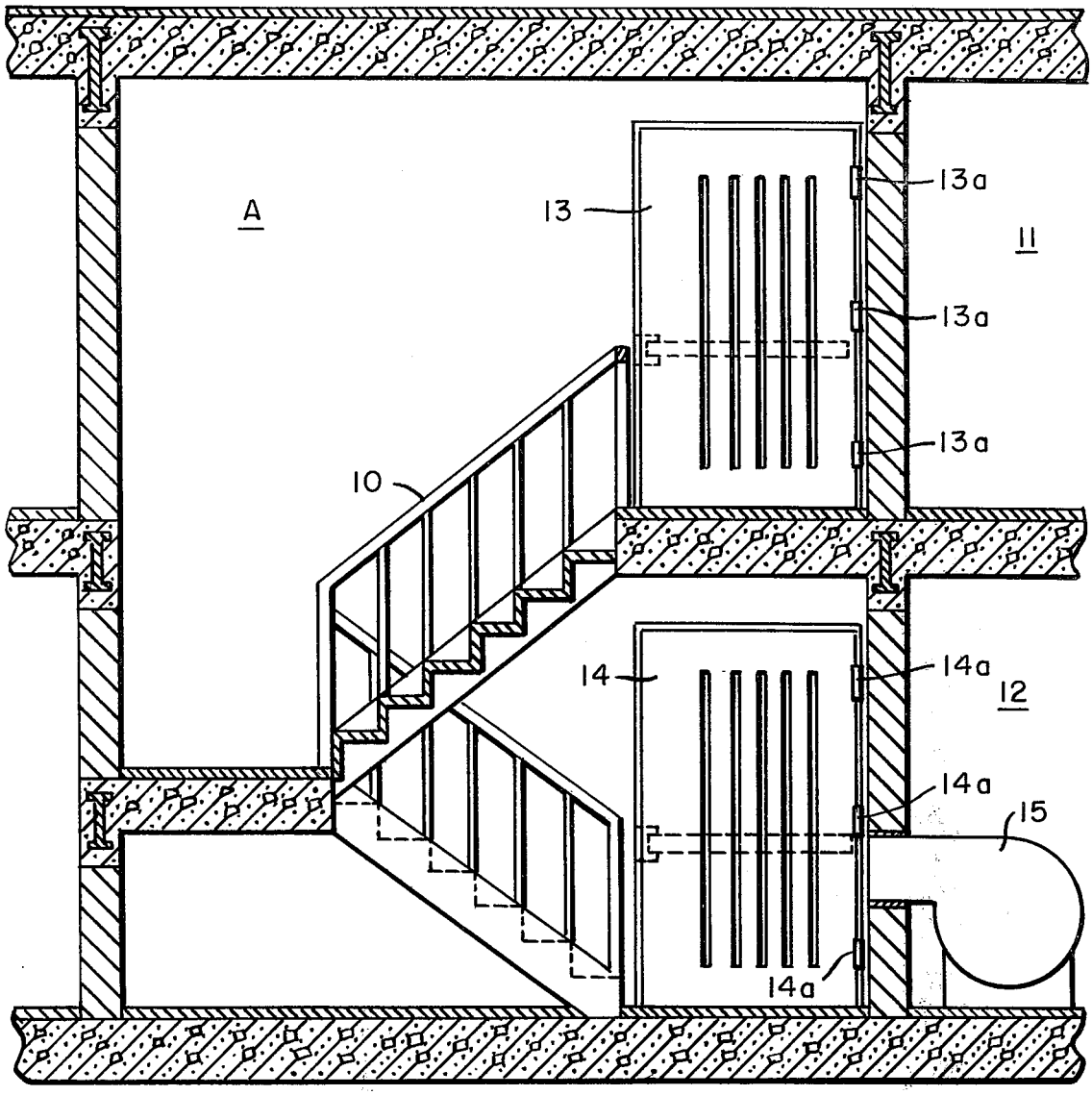
FIG. 1 is a schematic elevational view of a stairwell which connects the floors of a building, and in which air is pressurized in the event of an alarm signal.

As shown in FIG. 1 of the drawings A designates a chamber which in the drawing takes the form of a stairwell which has the stairs 10 leading from a second floor 11 to the ground floor 12. At the top of the stairway is a door 13 which opens into the stairwell and about its hinges 13a at one edge of the door, thus providing access from the second floor into the stairwell. At the bottom of the stairs is the door 14 which opens into the stairwell and about its side hinges 14a, thus providing access from the lower floor into the stairwell.

A blower 15 is arranged with its outlet connected to the stairwell so that when the blower is activated it delivers air under pressure into the stairwell. Such pressure is therefore applied against the insides of doors 13 and 14, and tends to hold these doors in closed position.

Doors 13 and 14 are similarly constructed and this construction will be more clearly understood by reference to FIGS. 2 to 11.

On the front or exterior side of the door, which is the side opposite the stairwell chamber, is a crash bar 16. This bar serves the usual purpose of a crash bar in releasing the latch of the door when a person pushes the bar toward the door, and in addition actuates the mechanism which controls the opening and closing of the air passages through the door.

The door, as illustrated, resembles the usual type of door with a hollow interior and providing an outside panel 17 and an inside panel 18. The outside panel 17 has the spaced vertical slots 19 which provide air passages through the panel (see FIG. 4). The inside panel 18 also has similar slots 20 which provide air passages through the panel. The slots 20 are arranged to register with slots 19.

Within the hollow of the door is a slide member 21 which, as shown, is in the form of a panel and which is arranged to move sidewise within the door. The slide member has slots 22 which, when the member moved to the left, as seen in 2 and 5, are out of register with slots 19 and 20; but when the member is moved to the right, as seen in FIGS. 4 and 6, the slots 22 are in register with slots 19 on the one side and with slots 20 on the other so that the closure is removed and the air passages are open through the door.

Figures 2, 3, 4, 5, 6, 7, 8, 9, 10, 11:
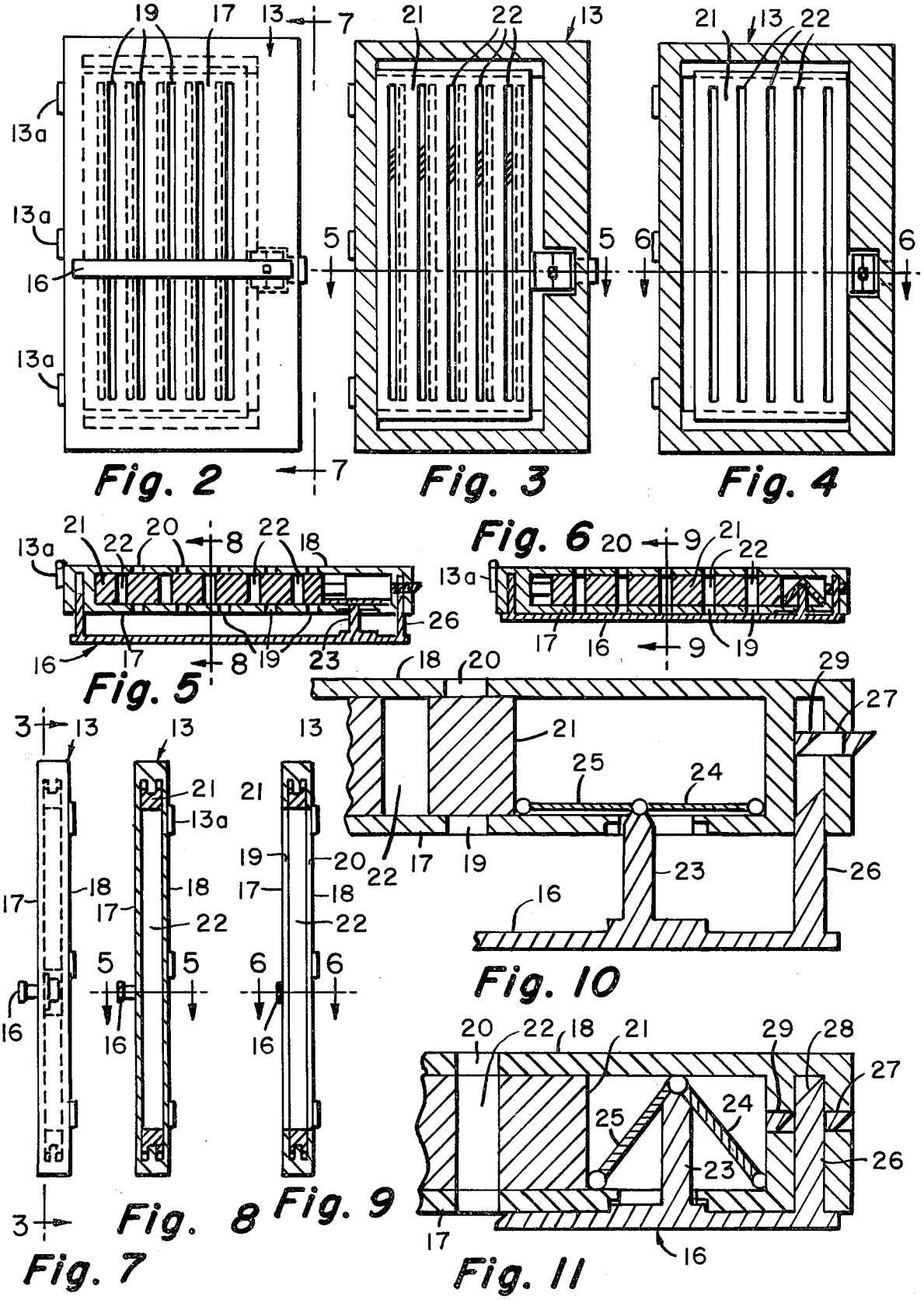
FIG. 2 is a view in elevation of the door, the view being taken from the front or exterior side of the door.
FIG. 3 is a sectional view taken at line 3—3 of FIG. 1 and shows the door with openings therein and a slide member having openings which are out of register with openings in the door so that the door openings are closed.
FIG. 4 is a sectional view like FIG. 3 but with the openings of the slide member in register with the door openings.
FIG. 5 is a sectional view taken along line 5—5 of FIG. 2.
FIG. 6 is a sectional view taken along line 6—6 of FIG. 3.
FIG. 7 is an edge view in elevation taken as seen from line 7—7 of FIG. 2.
FIG. 8 is a sectional view taken along line 8—8 of FIG. 5.
FIG. 9 is a sectional view taken along line 9—9 of FIG. 6.
FIG. 10 is a detail view in section showing the latch mechanism with the bolt extended and closure mechanism in normal position.
FIG. 11 is a detail view like FIG. 10 but showing the bolt withdrawn and the closure mechanism in position to open the passages through the door.

The mechanism for moving the slide member 21 from left to right and back again is more clearly understood with reference to FIGS. 10 and 11. Referring first to FIG. 10 the crash bar 16 has a pin 23 which extends through the outside panel 17 and the links 24 and 25 are each pivotally connected to the inner end of pin 23.

Link 24 has its other end pivotally connected to the edge portion of the door and link 25 has its other end pivotally connected to the right hand edge of the slide member 21.

As shown in FIG. 10 the links 24 and 25 are aligned and the slide member is moved to its farthest position toward the left which means that the slots 22 are not in register with the slots 19 and 20 and the passages through the door are closed. The latch which holds the door closed is shown as including the bolt 26 which may be spring pressed toward the extended position as shown in FIG. 10. However, there is on bar 16 a pin 26 which extends into the door in the area of bolt 27 and which has an inclined surface 28 at its extended end. The bolt 27 has a corresponding inclined surface 29 and when the bar 16 is moved toward the door the inclined surface 28 of pin 26 engages the inclined surface 29 of the bolt to retract the bolt and unlatch the door.

Also when the bar 16 is moved toward the door into the position shown in FIG. 11 it is obvious that the slide member will be moved to the right, and when the bar is fully depressed the slots 22 of the slide member will be brought into full registry with slots 19 and 20 of the door panels to completely open air passages through the door.

While in the illustrated embodiment the device is shown with the door having the two panels 17 and 18 it will be apparent that only one such panel is required to permit the working of the mechanism to open and close passages through the door. Either panel 17 or panel 18 may be omitted with the slide member being arranged to slide with respect to the remaining panel to bring the slots in the sliding member into and out of register with the slots in the remaining door panel.

While in the illustrated embodiment the means for unlatching the door includes a crash bar and I prefer to use a crash bar, this means for unlatching the door may take other forms, and whatever form such means may take its operation actuates the mechanism for opening the passages through the door and relieving the pressure which tends to hold the door shut.

OPERATION

When an emergency occurs such as a fire on one floor of a building the blower 15 may be manually or automatically turned on so as to bring the stairwell under air pressure greater than atmospheric. This provides protection against the spreading of the fire into the stairwell and into other floors of the building. At this point the slots 22 are out of register with slots 19 and 20 so that the air passages through the door are closed.

When occupants of the building attempt to pass from the building the most natural thing to do is to press the bar 16 toward the door. This movement operates, as previously explained, to retract the bolt 27 and unlatch the door. It also operates to depress the pin 23 which through links 24 and 25 operates to move the slide member 21 toward the right, as seen in FIG. 10, to bring the slots 22 into registry with slots 19 and 20 to open the air passages through the door.

The opening of the air passages through the door lessens the area of the door to which the air pressure within the stairwell chamber is applicable and so decreases the total pressure being applied against the door to hold it shut. This then allows the persons wanting to exit from any floor of the building to do so whereas without this assistance they might not be able to push open the door.

From what has been said it will be apparent that for greater relief against the pressure in the chamber the total area of the slots should be as large as practicable, with the limitation only that the area of the slots may not be so large as to prevent their being moved out of register when the slide member is moved to its extreme position toward the left (as seen in FIG. 10).

While the openings in the panels and in the slide member 21 are in the form of elongated vertical slots, these openings may be of other shapes. We prefer however, that these openings be in the form of the slots as shown because this shape lends itself more practically to providing the greatest relief from the added air pressure in the chamber.

While only one embodiment with certain specific variations thereon has been described in detail it will be apparent to those skilled in this art that the invention may take many and varied forms and all such forms and structures are to be considered within the spirit of the invention and contained within the scope of the appended claims.

I claim:

1. In a system for facilitating the escape of personnel from an area in which fire may exist, a chamber which is connected with said area by a doorway, a door which is hingedly mounted adjacent said doorway and normally closes said doorway, said door being movable into said chamber to open the doorway, said door having a releasable latch normally holding said door in closed position, means for bringing said chamber under elevated air pressure, said door having an air passage which extends from one side of the door to the other side, means for closing said passage which is also operable to open said passage to provide a passage for air through said door, means for unlatching said door, and means responsive to the operation of said unlatching means for actuating said means for opening said passage to reduce the area against which said elevated air pressure is applied and so assist in the opening of said door.

2. A device as set forth in claim 1 wherein said unlatching means includes a crash bar mounted on the side of said door opposite said chamber, said bar being movable toward said door, said closing means being operable to remove the closure of said passage when said bar is moved toward said door.

3. A device as set forth in claim 1 wherein said door has a panel containing an opening therein and wherein said closing means includes a slidable member having an opening therein and wherein said last mentioned means is operable to move said member into a position in which said openings in the panel are in register with said openings in said member to thereby open an air passage through said door.

4. A device as set forth in claim 1 in which said door has a plurality of said air passages and said closure means is effective to close each of said passages and is operative to remove these closures to provide a plurality of passages through said door.

5. A device as set forth in claim 4 in which said openings are in the form of elongated vertical slots.

6. A device as set forth in claim 3 wherein said door has a pair of said panels in spaced relationship and in which said slidable member is disposed between said panels.

* * * * *